United States Patent [19]

Hoffman et al.

[11] Patent Number: 4,728,358

[45] Date of Patent: Mar. 1, 1988

[54] IRON BEARING BRIQUET AND METHOD OF MAKING

[75] Inventors: Glenn E. Hoffman, Pineville; Bradford G. True, Charlotte, both of N.C.

[73] Assignee: Midrex International, B.V. Rotterdam, Zurich Branch, Zurich, Switzerland

[21] Appl. No.: 857,685

[22] Filed: Apr. 30, 1986

Related U.S. Application Data

[63] Continuation-in-part of Ser. No. 780,463, Sep. 26, 1985, abandoned, which is a continuation-in-part of Ser. No. 718,587, Apr. 1, 1985, abandoned.

[51] Int. Cl.[4] ..... C22B 1/24

[52] U.S. Cl. ..... 75/0.5 R; 75/3; 75/256; 420/117

[58] Field of Search ..... 75/256, 0.5 R, 3; 420/117, 590

[56] References Cited

U.S. PATENT DOCUMENTS 4,395,285 7/1983 Merkert ..... 75/256

FOREIGN PATENT DOCUMENTS 12712 2/1978 Japan ..... 75/256

OTHER PUBLICATIONS

Stephenson, R. L., *Direct Reduced Iron*, p. 224, Aug. 1982, TN 707 D56.

*Primary Examiner*—Melvyn J. Andrews
*Attorney, Agent, or Firm*—Ralph H. Dougherty

[57] ABSTRACT

A briquet consists essentially of metallized iron fines, formed by direct reduction of iron oxide, granulated or fine silica, a carbon source such as coke breeze, and less than 3.5 percent of other components, or impurities. The briquet product has a density of from 2.0 to 6.0 g/cc, and is particularly well suited for steelmaking operations.

The method for making the briquet is also disclosed.

11 Claims, No Drawings

IRON BEARING BRIQUET AND METHOD OF MAKING

CROSS REFERENCE TO RELATED APPLICATIONS

This application is a continuation-in-part application of U.S. patent application Ser. No. 780,463, filed Sept. 26, 1985, now abandoned which is a continuation-in-part application of U.S. patent application Ser. No. 718,587, filed Apr. 1, 1985 now abandoned.

BACKGROUND OF THE INVENTION

The present invention relates to briquets having a metallic iron content for use in the manufacture of iron and steel as well as the binder used in the making of such briquets and the method of agglomeration.

In the manufacture of iron and steel, it is customary to make certain additions to the melting furnace such as various metalliferous products in the form of alloys such as ferrosilicon. Ferrosilicon normally contains a substantial amount of carbon.

In the briquets of the present invention, metallized iron, silica and carbon form the composition of a briquet which is of high value for foundry practice and other iron and steelmaking uses. The briquet avoids the requirement for expensive ferrosilicon additions in the foundry or steelmaking practice in which it is used.

The invented briquet preferably employs metallized iron fines as the basic ingredient in its composition. Previously known briquets employ iron oxide fines. The presence of metallized fines reduces the energy requirement for melting the invented briquet over what is required in prior briquets. Since the iron fines are in the metallized condition, the energy normally required for reducing iron oxide to iron is not a requirement in any process utilizing the invented briquets as feed material.

It is also a theory to which we subscribe, but do not wish to be held, that the iron contained in the invented briquet acts as a catalyst during reduction of the silica contained therein in the melting of the briquet. Of course, since the iron in the briquet need not be reduced before melting, the energy requirement is reduced. Furthermore, the iron, having a high specific gravity with respect to the other components of the briquet, is responsible for imparting a high apparent density to the briquet. A high apparent density is critical to the previously mentioned application as it is directly related to the briquet thermal conductivity. That is, a briquet possessing a high thermal conductivity will be able to effectively transfer the required thermal energy necessary for initiating and completing the silica reduction reaction.

The mechanism of heat tranfer in a melter, such as a cupola, is by forced convection of hot gases flowing counter-current to the gravity fed charge, and also by radiation, both inter-particle, and to a lesser degree from the inside walls of the vessel to the charge. In the Merkert patent, silicon metal or high grade ferrosilicon is produced in an electric submerged arc furnace where a highly localized heat source is created by the arc. The electric arc generates the necessary thermal energy required for reduction of silica by resistance heating, both in the slag and to a greater extent in the liquid metal.

Forced convection plays a minor role in the transfer of thermal energy. Thus, while a dense compact and hence high thermal conductivity compact is not critical to the successful application of heat transfer by convection, it is advantageous, and thus a desirable improvement.

The closest known prior art patents include Pietsch U.S. Pat. No. 4,032,352, Rehder U.S. Pat. No. 4,179,283, Merkert U.S. Pat. No. 4,395,284, Querengasser et al U.S. Pat. No. 3,431,103, and Harrison U.S. Pat. No. 1,134,128.

Pietsch teaches a binder composition for agglomerating direct reduced iron fines in order to prevent reoxidation of the metallized iron contained therein. Pietsch does not include granulated silica in his briquet. Further, he does not include a carbonaceous reductant in the briquet for the purpose of reducing the silica. His pitch component is present for use as a binder. It is noted that water is an essential ingredient in all of the binder compositions claimed by Pietsch.

Rehder teaches the briquetting of metal oxides only and has no direct reduced iron in his briquet. He utilizes two sources of carbon, a high reactivity and a low reactivity carbon.

Merkert teaches a briquet in which iron and a binder are optional and are not essential ingredients. He prepares porous compacts for use as a feed material to an electric furnace, the material having a low apparent density, high internal porosity, and low thermal conductivity. Merkert states that up to about 15% of the silica weight can be iron particles. His product is used as charge material for making silicon or ferro-silicon. Merkert develops thermal energy from an electric arc, which requires electrode consumption. The present invention is a low cost, high-iron, ferrosilica briquet, which uses thermal energy from coal and coke, as opposed to Merkert's thermal energy from electricity.

Querengasser et al teach the production of ferro-silicon utilizing a briquet with iron contents only as high as 8%. This is substantially lower than the iron contents of the briquet products of the present invention.

Harrison teaches a ferro-silicon product which has from 53 to 54.5% silicon. He states that regular alloys have from 25 to 60% silicon, which is the equivalent of 38 to 66% silica ($SiO_2$), which is substantially more silica than that present in the invented briquet product.

The present invention differs from each of these prior art briquets as set forth above in that the invented briquets have a density of from about 2.0 to 6.0 g/cc, and contain silica, carbon and a high percentage of iron, which is over 60% metallized, when the briquets are made by hot compaction. When the briquets are made by cold compaction, a binder such as sodium silicate or a mixture of calcium hydroxide and molasses is used.

OBJECTS OF THE INVENTION

It is the principal object of this invention to provide an iron-bearing briquet which includes silica, which has a high thermal conductivity, and which briquet can be substituted for the more expensive ferrosilicon in various steelmaking and foundry practices.

It is another object of this invention to provide an iron-bearing, silica-containing briquet having a high apparent density.

It is also an object of this invention to provide an iron-bearing briquet which contains silica, wherein the principal component is metallized iron fines from a direct reduction furnace.

SUMMARY OF THE INVENTION

The briquet of the invention can be either a cold compaction briquet, which requires the use of a binder, or a hot compaction briquet, which requires no binder.

For a cold compaction briquet, the preferred binders are three parts lime and five parts molasses. Lime for the binder is in the form of hydrated lime, which is calcium hydroxide.

The range of components in the hot compaction briquet is:

50 to 88 percent metallized iron fines;
7 to 35 percent silica ($SiO_2$);
5 to 15 percent carbon; and
no more than 3.5 percent of other constituents.

All of these components should be in the finely divided form, preferably minus 3 millimeters.

When preparing a cold compaction binder, from 85 to 99 parts of the mixture of finely divided material is blended with 1 to 15 parts of binder, the optimum cold compaction briquet containing 92 parts of finely divided material and 8 parts of binder.

DETAILED DESCRIPTION

The invented iron bearing briquet consists essentially of from about 50 to 88% metallized iron, from about 7 to about 35% silica and from about 5 to about 15% carbon. The iron in the composition is in the form of iron fines, preferably made by direct reduction of iron oxide, and at least 60% metallized, but usually more than 80% metallized. "Metallized", as used throughout this specification does not mean coated with metal, but means nearly completely reduced to the metallic state, i.e., always in excess of 60% metal, and usually in excess of 80% metal in the material. In the case of "metallized iron", the term "metallized" means the percent of total iron present as metallic iron. Such metallized iron in many forms, including pellets, fines, and lumps, is well suited as feed material to steelmaking furnaces such as an electric arc furnace. Silica is present in fine or granulated form and the carbon is preferably a component of a solid fuel, such as coal or coke that alternatively could be pitch or tar.

When metallized fines are used in a briquet, less thermal energy is required to recover the silicon units than without the presence of metallized fines. This is true because carbon is already in solution, so it has a lower melting point. In theory, iron acts as the medium in which carbon is dissolved, which facilitates reduction of silicon. Perhaps liquid iron acts as a catalytic medium. Solid carbon is dissolved in liquid iron, which is then free to react with solid silica ($SiO_2$) to form silicon, which is contained in liquid iron, and carbon monoxide gas. Silicon remains in solution if carbon monoxide gas is present. Silica, however, is reduced primarily by carbon in solution with liquid carbon, not by carbon monoxide. Reduction of silica by carbon monoxide gas is believed to have slower reaction kinetics than carbon in solution with liquid iron. If there is only a small amount of iron present, silica will be only partially reduced.

Preferably, the particle size of all components is less than 3 millimeters, but most advantageously the particle size of all components will be less than 1.5 millimeters prior to briquetting.

A more advantageous range of components in the briquet is from 50 to 77% metallized iron, 15 to 35% silica, 8 to 15% carbon, and no more than 3.0 % of other components, such as gangue.

The mixture set forth above can be briquetted by hot briquetting at a temperature of at least 600° C. and a pressure of at least 1,000 pounds per square inch to form a hot iron-bearing briquet. The compacting step is preferably carried out at a temperature of from about 650° to 750° C.

More commonly, it is expected that cold briquetting of the composition will take place wherein from 85 to 99 parts by weight of the composition will be mixed with from 1 to 15 parts of a binder. The preferred binder is a mixture of calcium hydroxide and molasses in roughly equal parts, with an optimum composition of 3 parts lime to 5 parts molasses. However, each can be present in the amount of from 30 to 70% of the binder. Alternative binders are sodium silicate, pitch, and tars, other organic or chemical binders, and cements.

The range of density of the invented briquets is from 2.0 to 6.0 grams per cubic centimeter. High density promotes thermal and electrical conductivity. In addition, high density briquets will penetrate a slag layer in a furnace more meadily than low density briquets.

Briquets made according to the present invention and weighing between 44.0 and 46.5 grams were tested and found to have a density of from 2.38 to 2.49 g/cc. In a cold compaction briquet, the preferred density range is from 2.2 to about 4.0 g/cc, while a hot compaction briquet has a preferred density range of from about 2.2 to about 5.8 g/cc.

The invented briquet product is charged into a shaft furnace melter, such as a cupola or other melting furnace. Some of the silica in the briquet will be reduced during the melting process, and the metallic silicon will become available to the molten product as an alloying element. Thus it is seen that the present briquets can be substituted for the more expensive ferro-silicon.

In a cupola furnace, which is a melting furnace and not a reduction furnace, a loss in melting productivity results when reduction of both silica and iron oxide must be performed in the furnace. When only the silica must be reduced, that is if the iron oxide has already been reduced to the metallized iron form, the loss in melting productivity is minimized. In order to reduce silica in a briquet, iron must be present.

When the invented briquet is charged to a cupola furnace, the reaction produces a high degree of silica reduction at low temperatures, i.e. from about 1150° to about 1450° C., depending on the initial carbon content of the metallized iron fines. The invented briquet works equally well in both a cupola and a submerged arc furnace.

The briquet consists essentially of metallized direct reduced iron fines, fine or granulated silica, a carbon source such as coke breeze or coal fines, and a binder such as a mixture of calcium hydroxide and molasses. After the mixture is compressed into a briquet, the briquet can be dried or cured at low temperature such as from 150° to 200° C. (300° to 400° F.) in order to remove any moisture and to improve the green strength.

The following tables compare the chemical analyses of various ferrosilicon compositions with equivalent invented ferrosilica briquets.

TABLE I

| Ferrosilicon Designation | Ferrosilicon Analysis FeSi 5 | FeSi 10 | FeSi 25 |
|---|---|---|---|
| Fe | 94.5% | 89.5% | 74.5% |
| Si | 5.0 | 10.0 | 25.0 |
| C | 0.5 | 0.5 | 0.5 |

TABLE II

| Ferrosilicon Equivalent | Ferrosilica Briquet Composition FeSi 5 | FeSi 10 | FeSi 25 |
|---|---|---|---|
| Metallized Iron Fines | 86.7% | 75.9% | 51.6% |
| $SiO_2$ | 7.8 | 15.7 | 33.5 |
| C | 5.5 | 8.4 | 14.9 |

TABLE III

| | Ferrosilica Briquet Analysis FeSi 5 | FeSi 10 | FeSi 25 |
|---|---|---|---|
| Fe | 73.5% | 64.4% | 43.7% |
| FeO | 8.3 | 7.3 | 4.9 |
| C | 6.8 | 9.5 | 15.7 |
| $SiO_2$ | 9.1 | 16.8 | 34.3 |
| CaO | 0.8 | 0.7 | 0.5 |
| Other | 1.5 | 1.3 | 0.9 |

Table III clearly shows that the other components of the briquet besides the principal components, iron, carbon, and silica, varies from 1.4 to 2.3 percent. The range of other components, such as lime, titania, phosphorus compounds, sulfur, and gangue, that can be tolerated in the invented briquet is from about 0.8 to about 3.5 percent.

ALTERNATIVE EMBODIMENTS

The briquet could include additional carbon beyond the stoichiometric requirements in order to have a portion of the carbon act as fuel to provide the heat of reaction for reduction and supply the necessary energy to heat and melt the metallized iron and silicon to tapping temperature (about 2700° F. or 1500° C.).

Alternative binders of the matrix type such as coal-tar pitch, petroleum asphalt, Portland cement, clay, or Gilsonite, or binders of the film type such as sodium silicate, plastic resins, starch, Bentonite, or glues, or binders of the chemical type such as hydrated lime and carbon dioxide, sodium silicate and calcium chloride, or sodium silicate and carbon dioxide are all envisioned to be suitable binders for this application.

SUMMARY OF THE ACHIEVEMENTS OF THE OBJECTS OF THE INVENTION

From the foregoing description, it is readily apparent that we have invented a briquet product, wherein the principal component is direct reduced metallized iron fines, which briquet product is well suited for steelmaking and foundry practices, which has a high apparent density and high thermal conductivity, and which attains the objects set forth above. It is clear that modifications may be made without departing from the spirit of the invention, and no limitations are to be inferred except as specifically set forth in the appended claims.

We claim:

1. An iron-bearing briquet product consisting essentially of from 50% to 88% metallized direct reduced iron fines, which fines are from 60% to 97% metallized, from 7% to 35% silica, from 5% to 15% carbon in solid form, and up to 3.5% impurities.

2. An iron bearing briquet according to claim 1 wherein said carbon is present as coke.

3. An iron bearing briquet according to claim 1 wherein said carbon is present as coal.

4. An iron bearing briquet according to claim 1 wherein said carbon is present as pitch or tar.

5. An iron bearing briquet according to claim 1 wherein the particle size of the components is less than 3 millimeters prior to briquetting.

6. A briquet according to claim 5 wherein the particle size of the components is less than 1.5 millimeters prior to briquetting.

7. An iron bearing briquet according to claim 1 wherein said metallized iron is at least 80% metallized.

8. An iron bearing briquet according to claim 1 having a density of from 2.0 to 6.0 grams per cubic centimeter.

9. An iron bearing briquet according to claim 1 wherein the mole ratio of carbon to silica within the briquet is in excess of the stoichiometric requirement for reduction of silica to produce silicon and carbon monoxide gas.

10. A method of forming a hot iron-bearing briquet, comprising:

mixing from 50 to 88% hot metallized iron fines at a temperature of at least 600° C., from 7 to 35% silica, from 5 to 15% carbon, and no more than 3.5 % impurities; and compacting said mixture at a pressure of at least 1000 psi to form a hot iron-bearing briquet having a density of from 2.0 to 6.0 g/cc.

11. A method according to claim 10 wherein said compacting step is carried out at a temperature of from about 650° to 750° C.

* * * * *